US005242632A

United States Patent [19]

Mende

[11] Patent Number: 5,242,632

[45] Date of Patent: Sep. 7, 1993

[54] NONWOVEN FABRIC AND A METHOD OF MANUFACTURING THE SAME

[75] Inventor: Takayuki Mende, Kuga, Japan

[73] Assignees: Mitsui Petrochemical Industries, Ltd., Tokyo; Uni-Charm Corporation, Kawanoe, both of Japan

[21] Appl. No.: 942,154

[22] Filed: Sep. 8, 1992

Related U.S. Application Data

[62] Division of Ser. No. 552,462, Jul. 16, 1990, Pat. No. 5,180,620.

[30] Foreign Application Priority Data

| | | | |
|---|---|---|---|
| Jul. 18, 1989 | [JP] | Japan | 1-185569 |
| Aug. 23, 1989 | [JP] | Japan | 1-216961 |
| Sep. 11, 1989 | [JP] | Japan | 1-235370 |

[51] Int. Cl.[5] ..... D04H 1/72

[52] U.S. Cl. ..... 264/6; 156/167; 264/12; 264/511; 264/518; 264/112; 264/115

[58] Field of Search ..... 264/6, 510, 511, 518, 264/112, 115, 12; 156/167

[56] References Cited

U.S. PATENT DOCUMENTS

| | | | |
|---|---|---|---|
| 3,960,652 | 6/1976 | Conway et al. | 162/108 |
| 3,978,185 | 8/1976 | Butin et al. | 264/518 |
| 4,035,881 | 7/1977 | Zocher | 28/111 |
| 4,333,979 | 6/1982 | Sciaraffa et al. | 428/179 |
| 4,526,733 | 7/1985 | Lau | 264/12 |
| 4,588,630 | 5/1986 | Shimalla | 428/131 |
| 4,631,221 | 12/1986 | Disselback et al. | 428/166 |
| 4,741,941 | 5/1988 | Englebert et al. | 428/71 |
| 4,780,352 | 10/1988 | Palumbo | 428/138 |
| 4,781,962 | 11/1988 | Zamarripa et al. | 428/138 |
| 4,840,829 | 6/1989 | Suzuki et al. | 428/131 |
| 5,100,435 | 3/1992 | Onwumere | 156/167 |

FOREIGN PATENT DOCUMENTS

| | | |
|---|---|---|
| 57-17081 | 4/1982 | Japan . |
| 57-193311 | 11/1982 | Japan . |
| 64-64655 | 3/1989 | Japan . |
| 64-72745 | 3/1989 | Japan . |
| 2112828A | 7/1983 | United Kingdom . |
| 2180271A | 3/1987 | United Kingdom . |

*Primary Examiner*—Mary Lynn Theisen
*Attorney, Agent, or Firm*—Sherman and Shalloway

[57] ABSTRACT

This invention provides a bulky nonwoven fabric made of thermoplastic resin filaments, which is soft and highly permeable to water and gas and effectively absorbs moisture as well as shocks.

A nonwoven fabric according to the invention is made of fiber-like filaments of a thermoplastic resin material and comprises a base cloth layer made having densely distributed holes and a large number of cylindrical projections, each standing from the peripheral edge of one of the holes and made of fiber-like filaments similar to those of the base cloth layer and soft, its height being at least twice as large as the thickness of the base cloth layer.

The method of manufacturing a nonwoven fabric of the invention is characterized in that molten filaments are blown out of a melt-blow die onto a porous plate provided with a large number of air passage holes under a condition where ambient air pressure on the side of the plate facing the die is kept higher than the air pressure on the other side of the plate so that some of the filaments project outside from the air passage holes to form so many cylindrical projections due to the difference of pressure, the aggregate of filaments being then taken away from the porous plate. The method can comprise a film laminating step.

7 Claims, 20 Drawing Sheets

FIG.10

NONWOVEN FABRIC AND A METHOD OF MANUFACTURING THE SAME

This is a division of application Ser. No. 07/552,462 filed Jul. 16, 1990, now U.S. Pat. No. 5,180,620.

BACKGROUND OF THE INVENTION

This invention relates to a bulky and highly soft and shock-absorbing nonwoven fabric and a method of manufacturing the same.

Melt-blow type nonwoven fabrics produced by collectively bonding extremely fine thermoplastic resin filaments that have the toughness of fibers have been known and used typically for wipers and other applications.

Dry laid nonwoven fabrics produced by collectively bonding thermoplastic resin filaments that appear and feel like fibers have also been known and used mainly for top-layer seats of diapers.

Meanwhile, Japanese Patent Publication No. 57-17081 (U.S. patent application Ser. No. 535,003/1974) discloses an absorbing structure prepared by disposing a surface sheet of resin film on a sheet of absorbing material. Said resin film is provided with a large number of small circular holes per unit area, each of which holes carries a tapered capillary tube arranged around its periphery, which capillary tube penetrates into the inside of the absorbing material through its surface. An absorbing structure as described above has applications in diapers, sanitary napkins and lining pads of beds.

Japanese Patent Disclosure No. 57-19311 (U.S. patent application Ser. No. 230,488/1981) teaches a plastic film or web provided with evenly and densely distributed holes.

Japanese Patent Disclosure No. 64-64655 (DE Patent Application No. P 37 23 404. August 1987) teaches a plastic film having a large number of small circular holes formed on it as it is inflated and burst. The tiny debris of the burst sticking to the peripheries of the holes as so many projections.

Japanese Patent Disclosure No. 64-72745 discloses a sheet of nonwoven fabric, which is suitably used for a top-layer sheet of an absorbing item such as a diaper.

According to the teaching of the invention, the sheet forms a second layer of porous and water-repellent material which is fitted onto a first layer of aggregated filaments that comes to contact with the skin surface of the user. With such an arrangement, such a sheet may be suitably used as a top-layer sheet of an absorbing item.

Said Japanese patent disclosure also teaches a first and a second method of combining such a porous sheet with a nonwoven fabric, of which the first method comprises a step of preparing a nonwoven fabric and a porous sheet separately and a step of bonding them together, whereas, according to the second method, a fabric web is placed on a porous sheet and then the fabric web is rigidly bonded to the porous sheet to form an integrated item.

A melt-blow type nonwoven fabric is required to be soft, bulky and shock-absorbing when it is used for a shock-absorbing item or a wiper.

While a melt-blow type nonwoven fabric is normally flexible and soft, it has a poor gas and water permeability, making itself unsuitable for applications such as the top-layer sheet of a paper diaper which is required to immediately pass the discharged urine to the absorbing layer and hence should have a high water permeability.

Moreover, a nonwoven fabric should be highly soft, shock-absorbing and at the same time permeable to both water and gas particularly if it is used for a medical care item for covering a wound, a baby diaper which is required to be free from causing rashes on the skin or a bed pad for a patient staying in bed for a prolonged period of time without causing any sore skin.

Thus, top-layer sheets disclosed by the Japanese Patent Disclosures Nos. 57-17081, 57-193311 and 64-64655 cannot satisfactorily meet the above requirements because they are made of film and, although they are to some extent permeable to water and gas, give a chilly feeling, to say nothing of their insufficient softness that makes them undesirable to be brought into contact with the skin.

Although a nonwoven fabric can be made permeable to water and gas by boring small holes through it, a significant portion of the nonwoven fabric is wasted when holes are bored by mechanical means particularly when the holes are densely distributed throughout the fabric. Therefore, such a method of boring holes is unrealistic and economically not feasible. If the holes are bored by having the fabric pierced with needles, the periphery of each of the holes can be molten and then hardened and the hardened areas immediately lose their softness. Moreover, the fabric does not necessarily become soft by simply forming small holes running therethrough.

With a known top-layer sheet having a layer of nonwoven fabric, since the holes of the surface layer are covered by the nonwoven fabric, its water permeability is inevitably defined by the water permeability of the non-woven fabric. Moreover, it is obtained by simply laying a porous surface sheet on a non-woven fabric, it cannot provide a satisfactory elasticity nor a sufficient buffering property.

U.S. Pat. No. 4,041,951 also discloses nonwoven fabric for similar applications. It shows a disposable diaper having a substantially planar, moisture absorbent layer disposed between a soft and bulky, wearer-contacting top sheet which is uniformly moisture pervious along its entire surface and a moisture resistant backing sheet. The top sheet is comprised of a generally hydrophobic non-woven material and has depressed areas and non-depressed areas. The depressed areas are comprised of embossments and contact the uppermost surface of the substantially planar, moisture absorbent layer in use. The non-depressed areas contact the wearer's skin in-use.

With such a configuration, however, since it shows significant unevenness because of the embosses, the projecting sections become less soft without forming bulky cylindrical projections, making the touch of the top sheet less comfortable.

SUMMARY OF THE INVENTION

In view of the above described disadvantages of the known nonwoven fabrics, it is therefore the object of the present invention to provide a bulky nonwoven fabric made of thermoplastic resin filaments, which is soft and highly permeable to water and gas and effectively absorbs moisture as well as shocks, and a method of manufacturing the same.

A nonwoven fabric according to the invention comprises a base cloth layer made of thermoplastic resin filaments like so many fibers and having densely distributed holes and a large number of cylindrical projections, each standing from the periphery of one of the holes and made of fiber-like filaments which is similar to those of the base cloth layer and the projections are soft, its height being twice as large as the thickness of the base cloth layer.

The free ends of the cylindrical projections may be open or closed. While open free ends may enhance the water and gas permeability of the nonwoven fabric, it may be favorably used for a filter if the free ends are closed.

The projections can provide maximum shock absorbing effects and an excellent soft touch when at least the stem portion of the projection is standing upright or substantially 90° relative to the base cloth layer. Although conventionally such an arrangement cannot be easily realized, the present invention paved a way to providing a nonwoven fabric with such an arrangement without any difficulty.

Said base cloth layer may have a resin film lining. While such a lining may deteriorate the gas and water permeability of the base cloth layer, the projections may ensure the nonwoven fabric a sufficient gas and water permeability. Said resin film lining is preferably arranged on the side of the base cloth layer where the cylindrical projections are found because of the ease with which the nonwoven fabric is manufactured.

Alternatively, such a resin film may be used to cover the outer periphery of the cylindrical projections. Such an arrangement enables the cylindrical projections to stand firmly and consequently makes the nonwoven fabric particularly suitable for use as a buffer.

The holes of the base cloth layer preferably have a diameter between 0.2 mm and 6 mm. Preferably, it carries at least two holes per 1 $cm^2$. The diameter and the number per unit area of the holes can be appropriately determined as a function of the required softness, water permeability and other characteristics. For instance, if the pore diameter is between 0.2 mm and 1 mm and the number of holes is 50 or more in every 1 $cm^2$, the nonwoven fabric becomes very nappy because of the cylindrical projections.

The method of manufacturing a nonwoven fabric according to the invention is characterized in that molten fiber-like filaments are blown out of a melt-blow die onto a porous plate provided with a large number of air passage holes under a condition where ambient air pressure on the side of the plate facing the die is kept higher than the air pressure on the other side of the plate so that some of the filaments project outside from the air passage holes to form so many cylindrical projections due to the difference of pressure, the aggregate of filaments being then taken away from the porous plate.

The method of the present invention may be so modified that it comprises steps of placing a sheet of resin film on a porous plate provided with a large number of air passage holes and heating the resin film above the softening point of the resin.

reducing at the same time the ambient air pressure on the side opposite to the melt-blow die lower than the air pressure of the other side so that the resin film may project from the air passage holes to the side opposite of the die to form so many cylindrical film projections having an open free end and subsequently blowing molten filaments from a melt-blow die onto the resin film with the cylindrical film projections so that they may deposit on the resin film and part of the filaments may be pulled into the cylindrical film projections to form cylindrical projections of the filaments within the cylindrical film projections, the combined film and filaments being then taken away from the porous plate.

The product of melt-blowing may be removed from the plate either (1) after part of the blown filaments have projected from the air passage holes to form cylindrical projections whose further ends are closed or (2) after part of the blown filaments have projected from the air passage holes to form cylindrical projections whose further ends are broken by air pressure and therefore open.

The air pressure on the side of the porous plate facing the die and that of the other side may be differentiated either (1) by reducing the latter below the atmospheric pressure so that part of the filaments are attracted into the air passage holes by the negative pressure or (2) by transferring the porous plate close to the melt-blow die so that the former may be increased by the air blow applied to the plate by the melt-blow die and consequently part of the filaments are pushed into the air passage holes and eventually project from the other side.

Said porous plate may be replaced by a 5 to 60 mesh metal net or any other appropriate means. Such a metal net is advantageously used particularly when a nonwoven fabric with nappy or raised cylindrical projections having a bore between 0.2 mm and 1 mm at a rate of 50 or more per 1 $cm^2$ is manufactured.

Now the present invention will be described in greater detail by referring to the accompanying drawings that illustrate preferred embodiments of the invention.

BRIEF DESCRIPTION OF THE DRAWINGS

Of FIGS. 1 through 16 that show a first embodiment of the invention.

FIGS. 8 through 10 are photomicrographs, enlarged 30 times actual size, of a first example of the nonwoven fabric according to the invention, of which FIG. 8 shows a plan view of the side of the fabric carrying no projections, FIG. 9 shows a plan view of the side of the fabric carrying projections and FIG. 10 shows a sectional view of projections, FIGS. 11 through 13 are photomicrographs, enlarged 30 times actual size, of a second example of the nonwoven fabric according to the invention, of which FIG. 11 shows a plan view of the side of the fabric carrying no projections, FIG. 12 shows a plan view of the side of the fabric carrying projections and FIG. 13 shows a sectional view of projections, FIGS. 14 through 16 are photomicrographs, enlarged 30 times actual size, of a third example of the nonwoven fabric according to the invention, of which FIG. 14 shows a plan view of the side of the fabric carrying no projections, FIG. 15 shows a plan view of the side of the fabric carrying projections and FIG. 16 shows a sectional view of projections.

Figure 17:
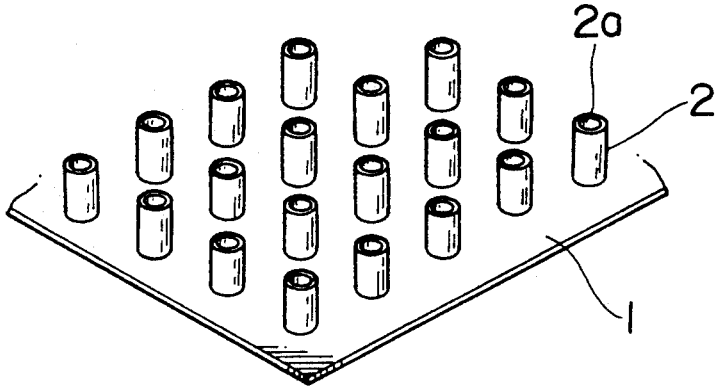
Figure 18:
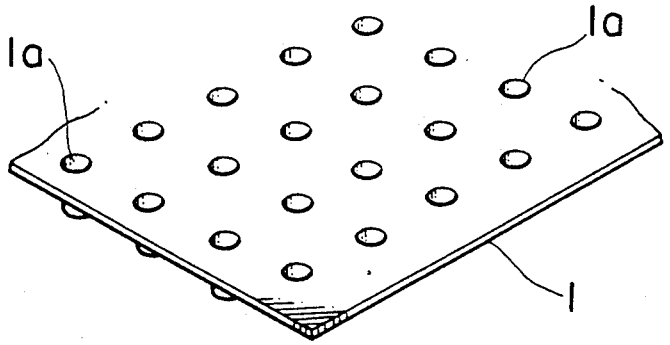
Figure 19:
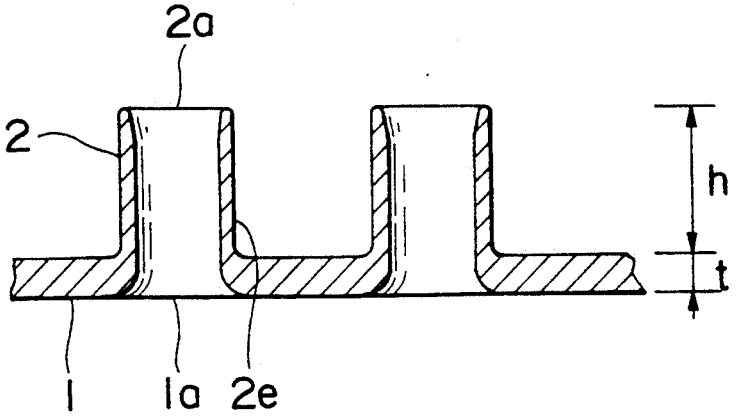
Figure 20:
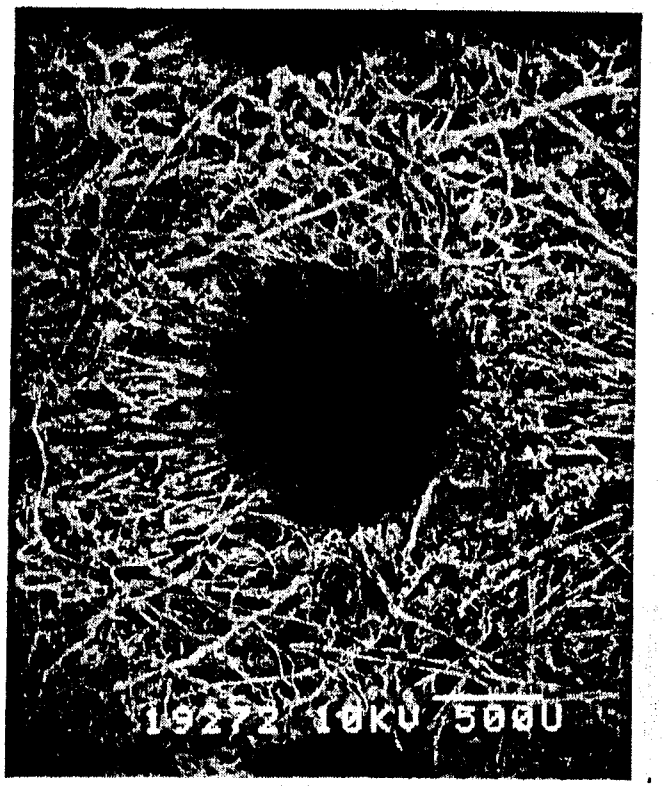
Figure 21:
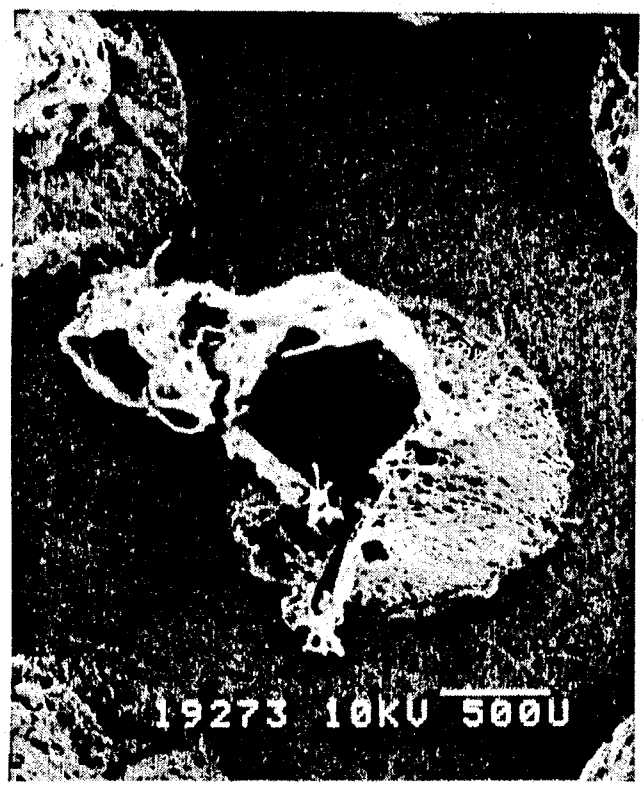
Figure 22:
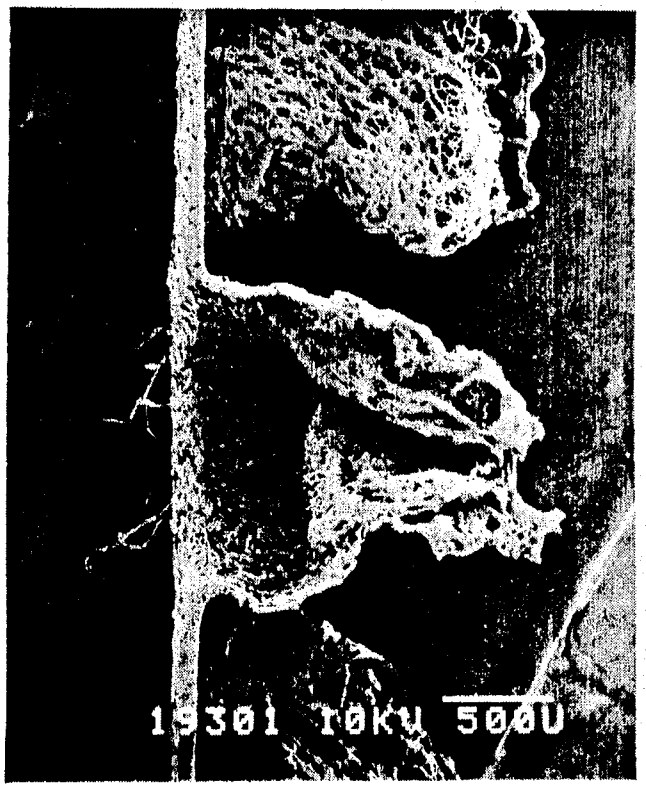
Figure 23:
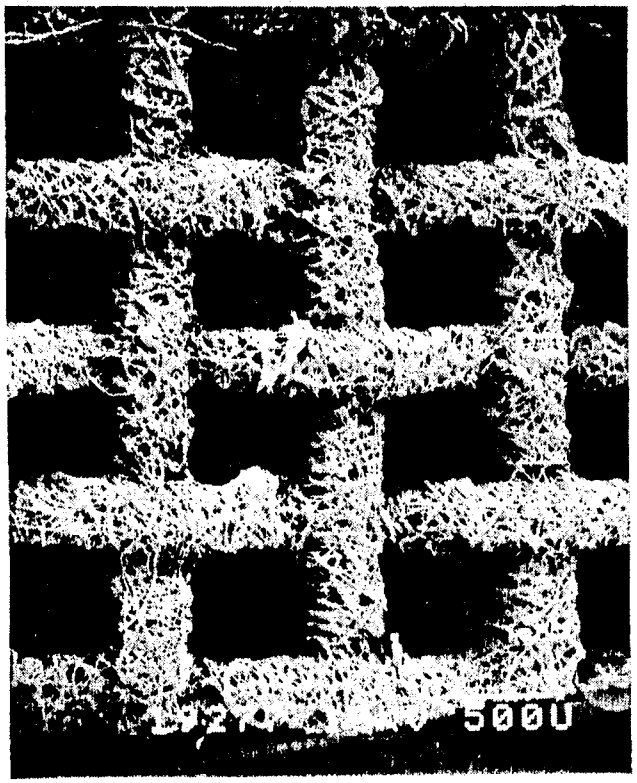
Figure 24:
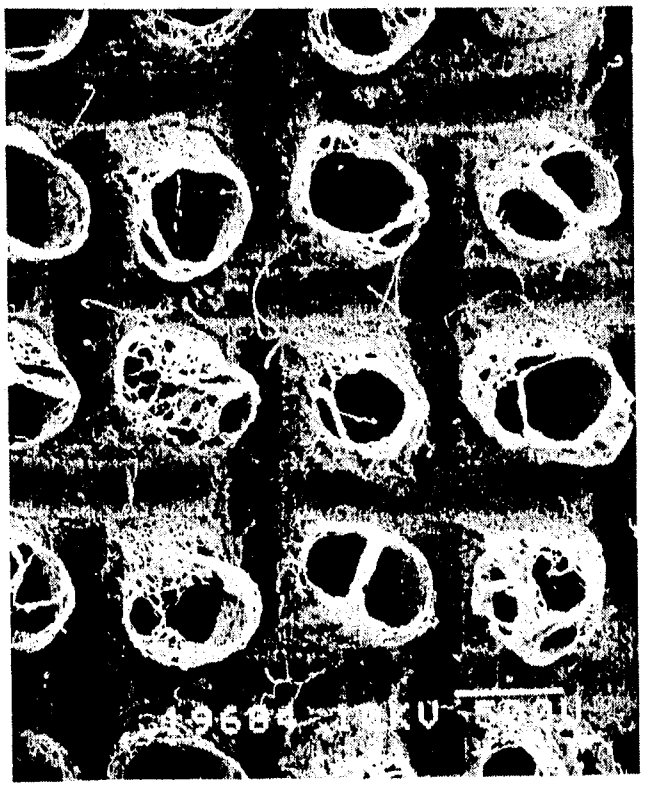

Of FIGS. 17 through 24 that show a second embodiment of the present invention,

FIG. 17 is a perspective view of the embodiment of the melt-blow type nonwoven fabric of the invention as viewed from the front side of the fabric, FIG. 18 is a perspective view similar to FIG. 17 but viewed from the back side thereof, FIG. 19 is a sectional view of the embodiment, FIGS. 20 through 24 are photomicrographs, enlarged 30 times actual size, of a fourth and a fifth example of the nonwoven fabric according to the invention, of which FIG. 20 is a plan view of the front side of the fourth example showing the state of some of the filaments of the fabric, FIG. 21 is a plan view of the rear side of the fourth example showing the state of some of the filaments, FIG. 22 is a sectional view of some of the projections of the fourth example showing how the filaments there look like, FIG. 23 is a plan view of the front side of the fifth example showing the state of some of the filaments of the fabric and FIG. 24 is a plan view of the rear side of the fifth example showing the state of some of the filaments of the fabric.

Figure 4:
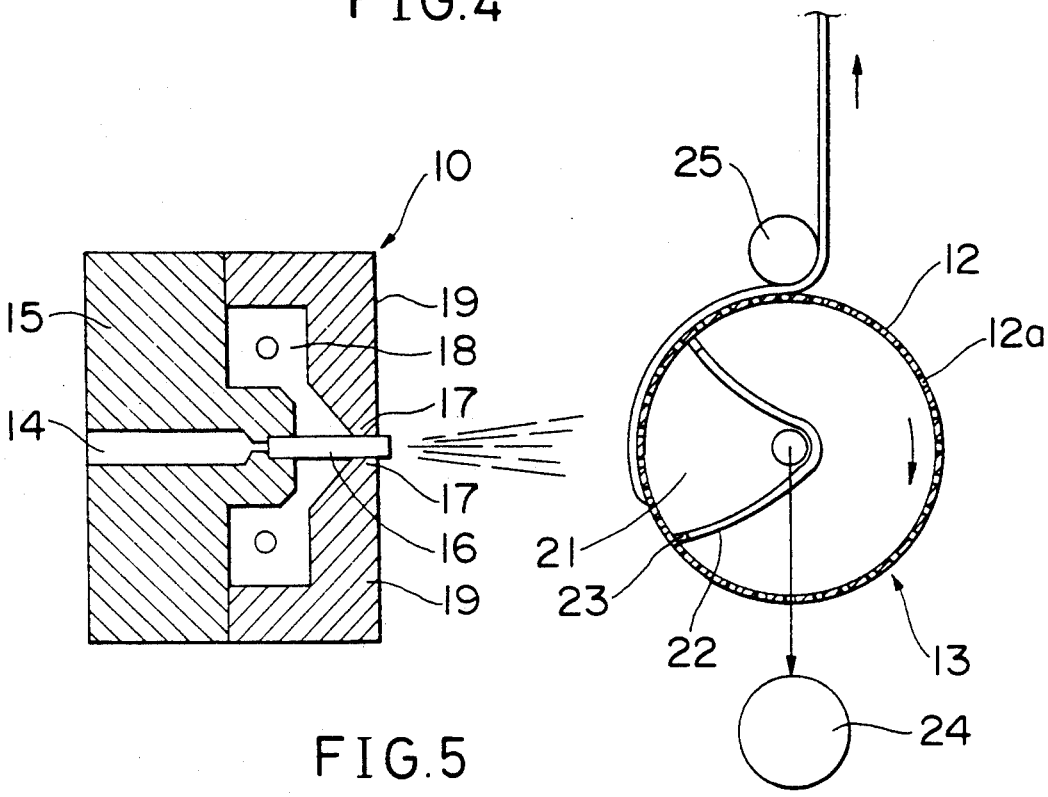
FIG. 4 is a sectional view of a melt-blow die apparatus specifically designed for the method of manufacturing a melt-blow type nonwoven fabric same as the embodiment.
Figure 5:
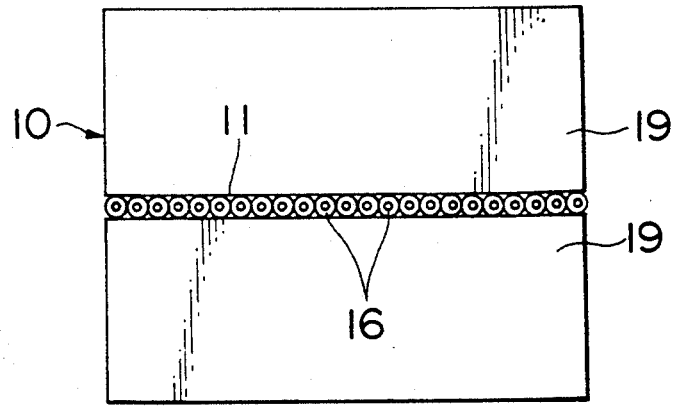
FIG. 5 is a front view of the die of FIG. 4.
Figure 6:
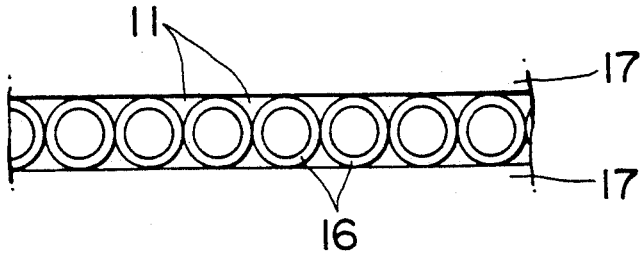
FIG. 6 is an enlarged partial view of the die of FIG. 4.
Figure 7:
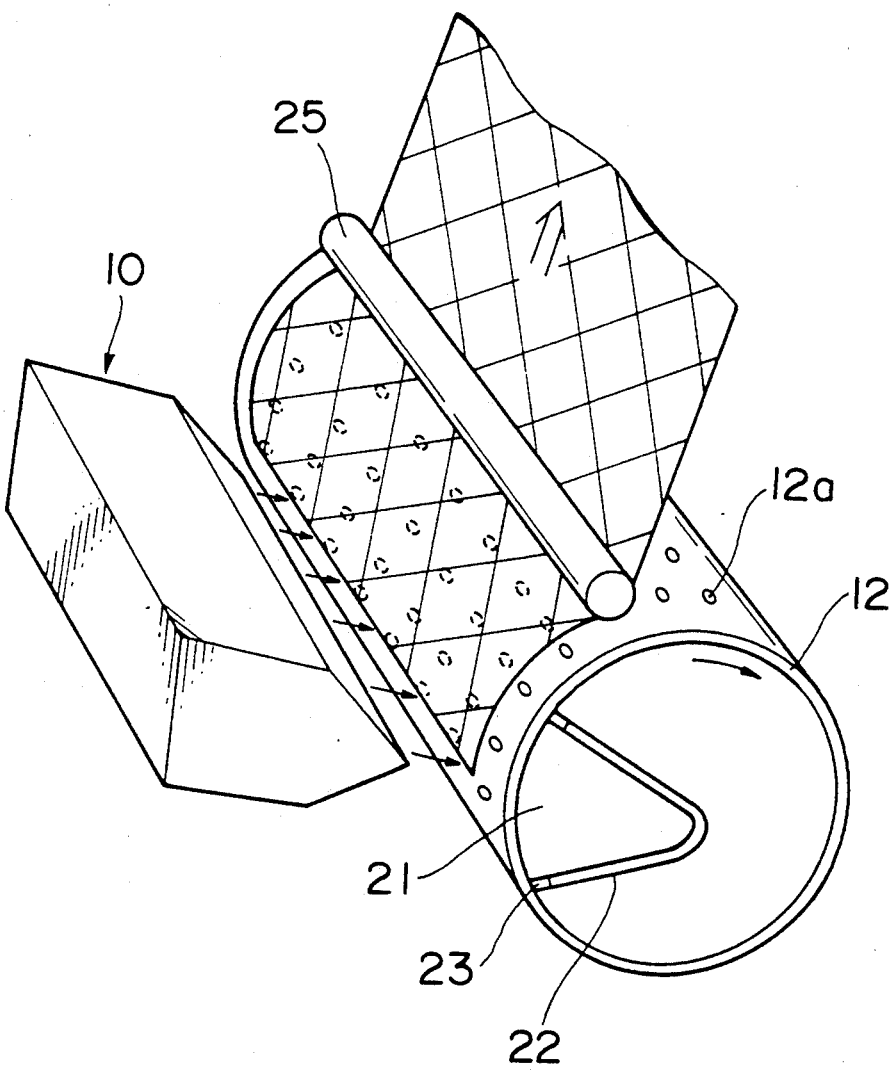
FIG. 7 is a perspective view of the apparatus of FIG. 4, illustrating how filaments are blown against a porous plate and pulled into the air passage holes of the plate.
Figure 25:
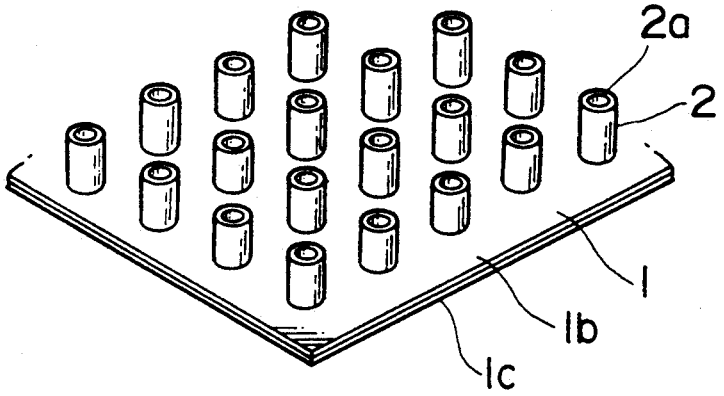
Figure 26:
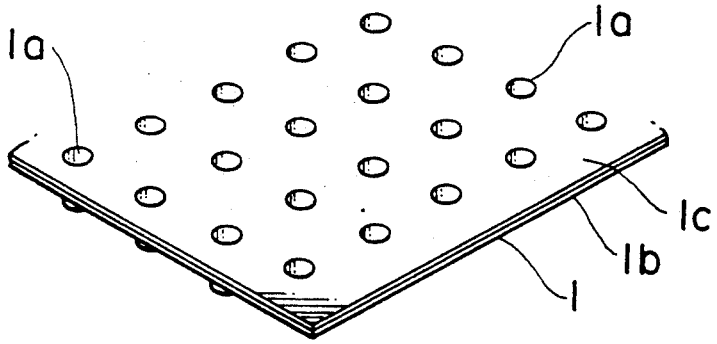
Figure 27:
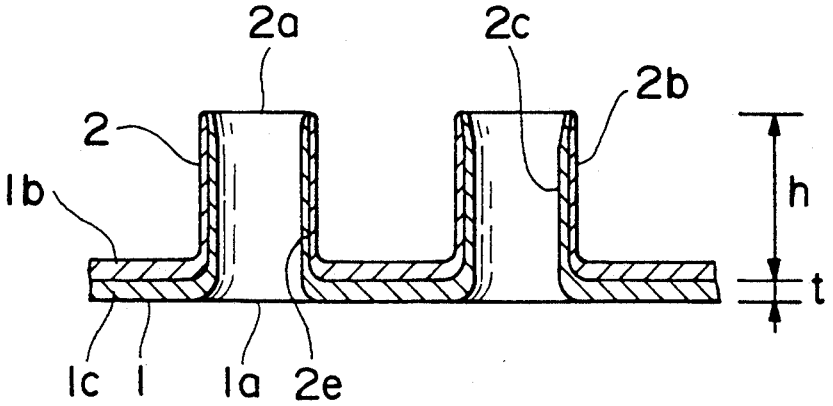
Figure 28:
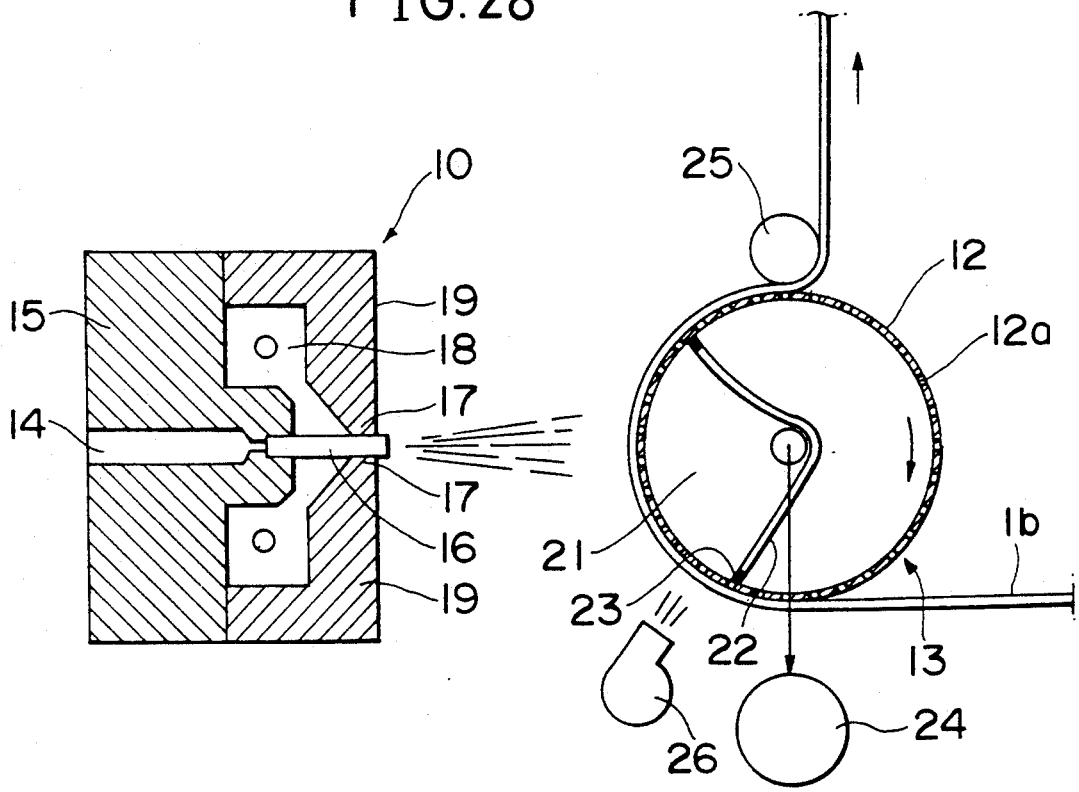
Figure 29:
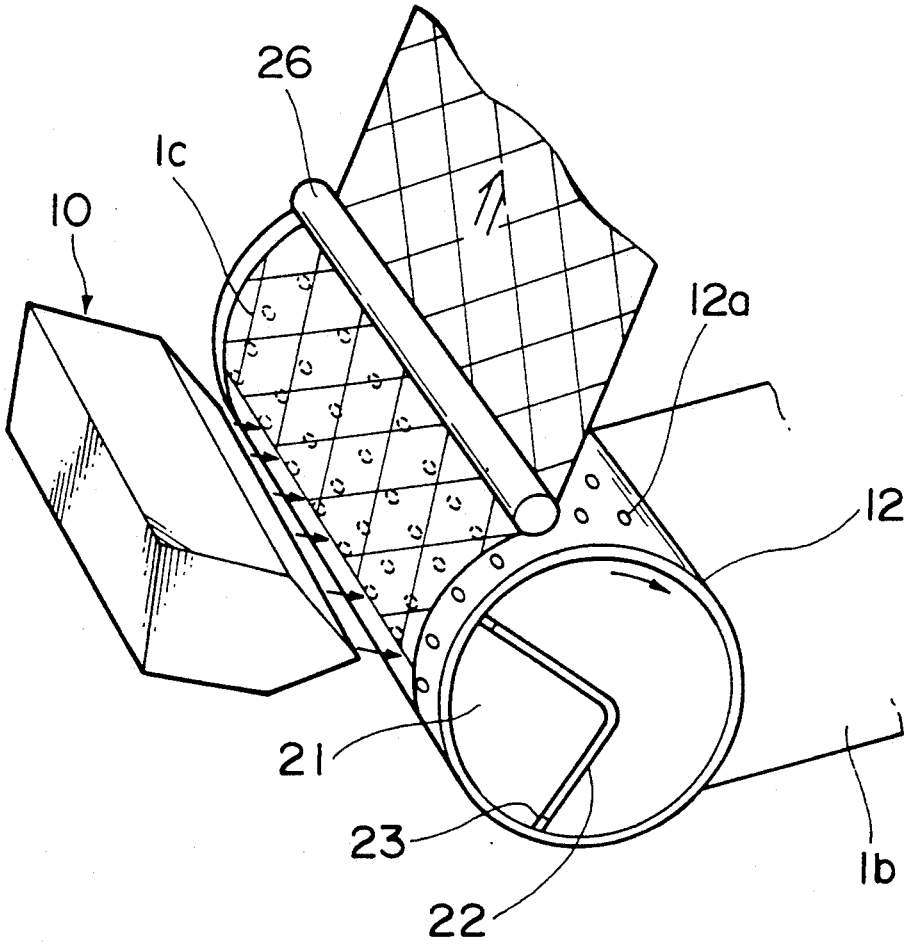
Figure 30:
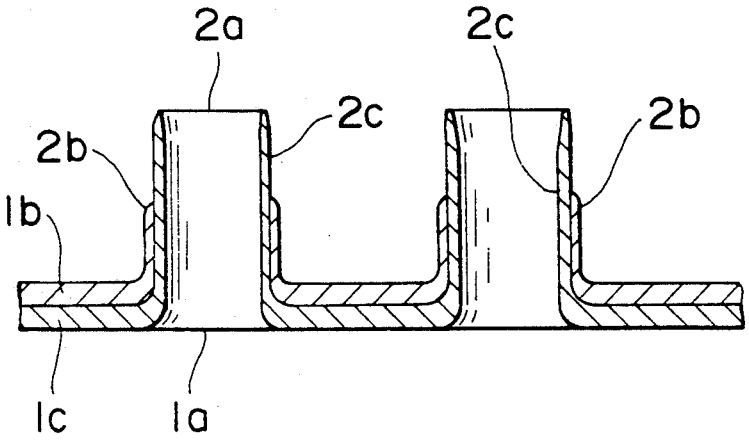
Figure 31:
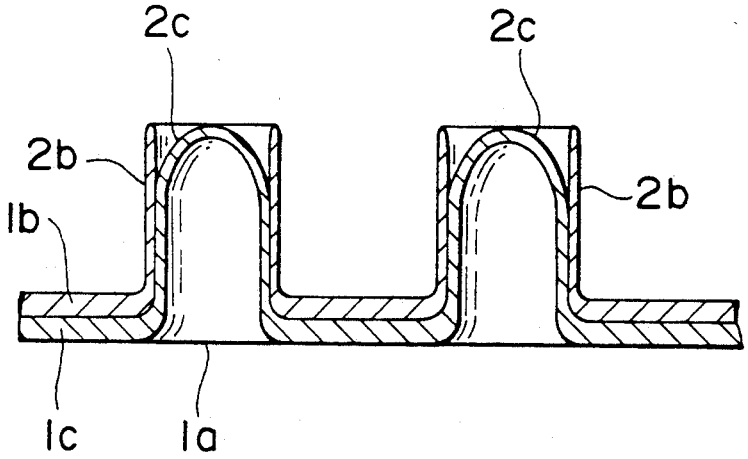

Of FIGS. 25 through 31 that show a third embodiment of the present invention,

FIG. 25 is a perspective view of a sixth example of the porous nonwoven fabric multi-layered sheet of the invention as viewed from the front side of the fabric, FIG. 26 is a perspective view similar to FIG. 17 but viewed from the back side thereof, FIG. 27 is a sectional view of the example, FIG. 28 is a sectional view of a melt-blow die apparatus specifically designed for the method of manufacturing a melt-blow type nonwoven fabric same as the third embodiment, FIG. 29 is a perspective view of the die of FIG. 4, FIG. 30 is a sectional view of a seventh example of the porous nonwoven fabric multi-layered sheet of the invention and FIG. 31 is a sectional view of an eighth example of the porous nonwoven fabric multi-layered sheet of the invention.

DETAILED DESCRIPTION OF THE INVENTION

Embodiment 1

Figure 1:
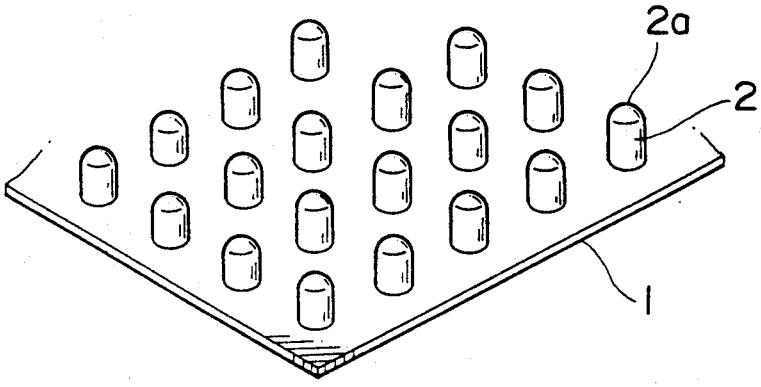
FIG. 1 is a perspective view of the embodiment of the melt-blow type nonwoven fabric of the invention as viewed from the front side of the fabric.
Figure 2:
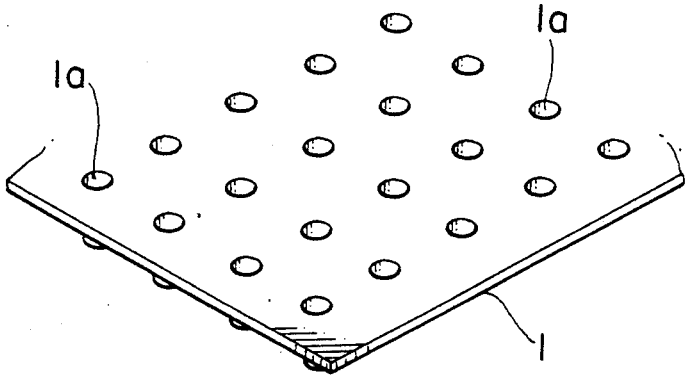
FIG. 2 is a perspective view similar to FIG. 1 but viewed from the back side thereof.
Figure 3:
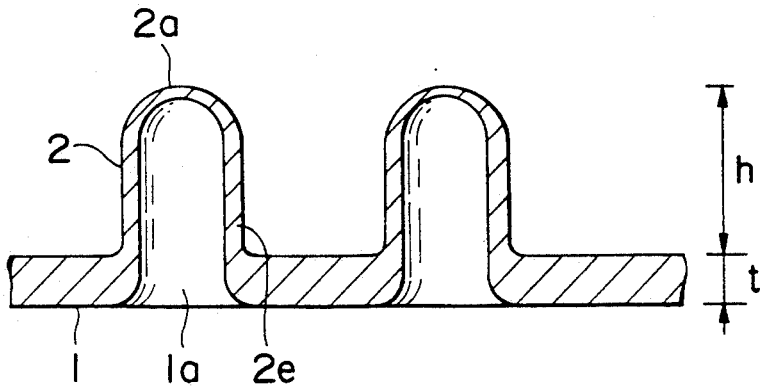
FIG. 3 is a sectional view of the embodiment.

The first embodiment of the invention as illustrated in FIGS. 1 through 3 is formed by thermoplastic resin filaments and comprises a base cloth layer 1*a* provided with a number of holes and the same number of cylindrical projections 2 each formed on a peripheral edge around the corresponding holes 1*a*, the cylindrical projections 2 being made of filaments similar to those of the base cloth layer 1 and therefore soft, the free ends 2*a* of the projections being closed, the projections having a height (h) at least twice as large as the thickness (t) of the base cloth layer 1. The embodiment is a melt-blow type nonwoven fabric and is manufactured by a method according to the invention.

Thermoplastic resin filaments to be used for the base cloth layer 1 and the cylindrical projections 2 can be made of any of the materials including low density polyethylene, high density polyethylene, polypropylene, polyl-butene, poly4-methyl-1-pentene and monopolymers of ethylene as well as random and block copolymers of aolefins such as propylenel-butene and 4-methyl-1-pentene. Other materials that can be used for the purpose of the invention include ethylene and vinyl copolymers such as ethylene-acrylic acid copolymer, ethylene-vinyl acetate copolymer, ethyl-vinyl alcohol copolymer, ethylene-vinylchloride copolymer; styrene resins such as polystyrene, acrylonitrile-styrene copolymers, acrylonitrile-butadiene-styrene copolymers, methyl methacrilic acid-stylene copolymer and a-methylstyrene-styrene copolymer; vinylchloride resins such as polyvinylchloride, poly-vinylidenechloride and vinylchloride-vinylidenechloride copolymer; polyacrylates such as poly(methylacrylate) and poly(methyl-methacrylate); polyamides such as nylon 6, nylon 6-6, nylon 6-10, nylon 11, nylon 12; thermoplastic polyesters such as poly(ethylene-terephthalate) and poly(butylene-terephthalate); polycarbonates and poly (phenyleneoxides). Any of these materials may be used either independently or in suitable combinations.

In this embodiment, the length and the diameter of the filaments involved may be varied by modifying the rate of the gas flow used for blowing filaments, the viscosity of the molten resin, the melt-flow rate and/or the caliber of the die orifices. Fibers to be used for this embodiment may be longer than 10 cm or as short as somewhere between 1 cm and 5 cm.

As for the diameter of the filament, filaments with a diameter between 1 and 10 um and mostly between 2 um and 5 um are generally used for melt-blow type nonwoven fabrics and such filaments can also be suitably used for the embodiment. When such filaments are used for the embodiment, it will show an improved gas permeability over conventional nonwoven fabrics because it has a surface area significantly larger than that of conventional fabrics.

As illustrated in FIGS. 2 and 3, the base cloth layer 1 is provided with a large number of holes 1*a*. A cylindrical projection 2 is disposed around each of the holes 1*a* made of filaments similar to those of the base cloth layer 1 and having a closed free end 2*a*.

It should be noted that the holes 1*a* are not necessarily circular and may be oval, square or of any other appropriate shape. The diameter of the holes 1*a* is between 0.2 mm and 6 mm, preferably less than 3 mm and more preferably between 0.4 mm and 2 mm. If the holes 1*a* is of a shape other circular, the diameter here means that of a circle that completely surrounds the holes of a given shape or the smallest circumcircle of the hole. A hole with a diameter less than 0.2 mm is not recommendable because the cylindrical projection standing from the periphery of the hole 1*a* can be easily separated. To the contrary, holes with a diameter greater than 6 mm can give a coarse touch and disagree with the surface of an object to which they are applied and which can be jaggy.

The diameter of the hole 1*a* necessarily defines the size of the cylindrical projection 2 standing from its peripheral area. A small hole 1*a* carries a small cylindrical projection 2 on its periphery edge. As a matter of course, cylindrical projections 2 arranged on holes 1*a* with a diameter between 0.2 mm and 1 mm and those on holes 1*a* with a diameter between 1 mm and 6 mm give different appearances and feelings to the user.

The density of holes on the base cloth layer 1 is two or more than 2 and preferably five or more than 5 per 1 $cm^2$, although it may be dependent on the diameter of the hole.

When the diameter is between 0.2 mm and 1 mm and the density is more than fifty per 1 $cm^2$, the cylindrical projections 2 can give a nappy or raised appearance to the nonwoven fabric that carries them.

The height (h) of the cylindrical projections 2 is at least twice and preferably more than four times as large as the thickness (t) of the base cloth layer 1 to make the nonwoven fabric appear and feel bulky. (See FIG. 3.) In other words, with such an arrangement, the nonwoven fabric appears very fluffy, light and soft as well as thick. When the height of the projections is less than twice as high as the thickness of the base cloth layer 1, the nonwoven fabric loses its bulky appearance.

With such projections 2, the nonwoven fabric is highly resilient, buffering and soft and gives a cozy feeling to the touch of the user.

The embodiment of the melt-blow type nonwoven fabric of the invention is manufactured by a method as described below.

Melt-blow filaments are blown out from a melt-blow die onto a porous plate having a large number of air passage holes until a deposit of filaments is formed on the plate. During this blowing operation, the pressure of the ambient air on the side of the plate opposite to the melt-blow die is made lower than the air pressure on the side of the plate facing the die so that some of the filaments blown onto the plate come to project from the air passage holes to form so many cylindrical projections as they are pulled by the negative pressure. After forming the projections, the aggregate of the filaments deposited on the plate is removed from the latter.

An apparatus to be used for the melt-blow operation typically comprises a die 10 arranged at the front end of an extruder, the die 10 comprising by turn gas blow-off orifices 11 arranged in the vicinity of die orifices for blowing off resin (if capillary tubes are used for resin blow-off orifices, in the vicinity of the capillary tubes), pressurized and heated gas being blown out of the gas blow-off orifices 11 toward the die orifices and then further directed toward a porous plate 12 to carry resin in the form of elongated filaments up to the plate 12, where the filaments are cooled and form a nonwoven fabric having a large number projections.

The porous plate 12 is movable and so moved that a long strip of nonwoven fabric may be formed as filaments are deposited on the plate. While a flat porous plate 12 is illustrated in the drawings, it is preferably realized in the form of a roller that can be freely rotated around its axis so that an endless strip of nonwoven fabric may be formed around it.

The air passage holes 12*a* of the porous plate 12 have a shape and size which is suitable for forming pores on the nonwoven fabric.

The porous plate 12 may be either a plate of iron or a similar material through which a number of holes are formed or a metal net whose meshes function as air passage holes 12*a*. If a metal net with fine meshes is used, the size of the air passage holes 12*a* can be reduced as compared with an iron plate provided with a number of holes. A 60 to 20 mesh metal net is suitably used to produce a base cloth layer 1 having holes with a diameter between 0.2 mm and 1 mm.

A nonwoven fabric as this embodiment produced by using a metal net with fine meshes has fine cylindrical projections 2 that give the fabric the appearance of a fluffy woven fabric like a carpet which is very soft when touched.

For producing a nonwoven fabric, molten resin is extruded from the extruder and at the same time pressurized and heated gas is blown off from the gas blow-off orifices 11 so that the molten thermoplastic resin is broken down into filaments and flown toward the porous plate. The filaments continuously hit the moving or rotating porous plate 12 before their temperature goes down below the softening point of the resin so that the filaments are continuously and evenly deposited on the porous plate 12. Since the filaments are scarcely elongated by the gas flow during their journey to the porous plate 12, the temperature of the thermoplastic resin should be well above the softening point when it is extruded so that the gas flow can produce cylindrically elongated projections on the porous plate 12.

The air pressure on the filaments-carrying side of the porous plate 12 is maintained to be higher than the air pressure on the opposite side of the plate to produce a difference of pressure.

Such a difference of pressure is preferably produced by reducing the pressure of the opposite side of the porous plate 12 so that the filaments arriving at the open areas 12*a* of the porous plate 12 are drawn toward the opposite side by the suction force generated by the difference of pressure to form elongated cylindrical projections 2. A vacuum suction pump may be used for reducing the pressure.

Alternatively, the air pressure on the filaments-carrying side can be increased to produce a sufficient pressure difference simply by drawing the porous plate 12 close to the melt-blow die 10. In other words, the pressurized and heated gas blown out of the gas blow-off orifices boosts the ambient air pressure on the filaments-carrying side of the porous plate 12 and consequently produces a pressure difference between the two sides of the plate 12 so that the filaments arriving the air passage holes 12*a* of the plate 12 are pushed further away through the air passage holes 12*a* toward the opposite side by the air pressure to form projections 2.

However, if this alternative technique of producing a pressure difference is used, care should be taken not to pull the porous plate 12 too close to the melt-blow die 10 because the filaments on the porous plate 12 can be bonded together to form a film because the filaments hit the plate 12 before they are sufficiently cooled.

As filaments are deposited on the porous plate 12, a base cloth layer 1 is formed on the surface of the plate 12 except the area of the air passage holes 12*a*, where the base cloth layer 1 shows corresponding holes 1*a*, each carrying a projection 2 made of the same resin material and standing from the peripheral edge of it toward the opposite side of the plate 12 due to the difference of pressure. The gas pressure applied to the filaments blown toward the plate should be high enough relative to the air pressure of the opposite side in order to elongate the projections 2 formed on the base cloth layer 1 and realize sufficiently elongated cylindrical projections 12*a* each having a closed free end. When such projections 2 are formed, the deposited aggregate of filaments on the porous plate 12 is removed from the plate 12 to obtain a melt-blow type nonwoven fabric.

With the use of the method of manufacturing a nonwoven fabric as described above, a stem portion 2e of the cylindrical projections will be standing upright by substantially 90° from the base cloth layer 1 to maximize the shock-absorbing effect and soft touch of the projections 2.

It may be understood now that the make of a nonwoven fabric and particularly that of cylindrical projections 2 are closely related with the viscosity and melt-flow rate of the molten resin as well as with the diameter and strength of the filaments, the distance (collection distance) between the die 10 and the porous plate 12 and the difference of pressure between the two opposite sides of the plate 1. When the viscosity of the resin is high and the diameter or the strength of the filaments is large, a large difference of pressure will be required to draw or drive off filaments for the formation of projections. To the contrary, if the viscosity is rather low, a relatively small pressure difference will be needed to pull or drive filaments. In any event, the collection distance is so adjusted that the filaments blown off from the die 10 are deposited on the porous plate 12 before their temperature goes down below the softening point of the resin and the pressure difference is so determined that filaments are subjected to a stress higher than the critical elongation stress of the resin while they are kept at a temperature higher than the softening point.

Thus, the touch of the obtained nonwoven fabric and the shape of its projections 2 depend on the viscosity and melt-flow rate of the resin, the diameter and strength of the filaments, the collection distance and the pressure difference.

A melt-blow type nonwoven fabric obtained by using the above described method may be subsequently subjected to a hydrophilic treatment in the presence of a surface active agent or, contrarily, to a hydrophobic treatment using a water-repellent agent depending on the intended use of the nonwoven fabric. A sheet of film or paper or another nonwoven fabric may be bonded to the flat side of the fabric which is free from projections 2.

The final product of such a melt-blow type nonwoven fabric may find a number of applications including the top-layer sheet of a diaper, the top-layer sheet of a sanitary napkin, a shock-absorbent, a water-repellent sheet, an ornamental sheet and a thermal and/or sound insulation sheet.

When a sheet of film or paper or another nonwoven fabric is bonded to the projections-carrying side of such a nonwoven fabric, the final product will be a sheet similar to a corrugated cardboard that can be suitably used for thermal and/or sound insulation.

Such a nonwoven fabric can also suitably be used for air or water filters because of its large surface area.

EXAMPLE 1

A melt-blow die 10 used for this example comprises as illustrated in FIGS. 4 through 7 (1) a die block having a resin chamber 14 for containing molten resin to be extruded, (2) a plurality of capillary tubes 16 arranged on a plane and each having a base terminal portion held by the die block 15 and communicating with the resin chamber 14 and (3) a pair of gas plates 19 having respective lip sections 17 for holding the front ends of the capillary tubes 16 between respective holding flat surface areas thereof to form gas blow-off orifices 11 between the holding flat surface areas and the capillary tubes 16, wherein the gas plates and the die block 15 are assembled together to form a gas chamber 18 between the die block 15 and the gas plates 19 and the gas chamber 18 communicates with the gas blow-off orifices 11.

The front ends of the capillary tubes 16 are slightly projecting from the lip sections 17.

Facing the capillary tubes 16, a collector apparatus 13 comprising a rotatable porous roll prepared by rounding a porous plate 12 is arranged in front of the melt-blow die 10. Said collector apparatus 13 is movable toward and away from the die 10 so that the distance (collection distance) between the front ends of the capillary tubes 16 and the outer surface of the porous plate 12 can be adjusted. A partition 22 is disposed within the porous roll in order to form a negative pressure chamber 21 behind the area of the porous roll that receives filaments coming from the die 10. Slidable seals 23 are arranged on the edges of the partition 22 that contact with the inside of the porous roll in such a manner that they effectively prevent air from entering into the negative chamber 21 but do not block free rotary movement of the porous roll. A vacuum suction pump 24 is connected with the negative chamber by means of a pipe in order to keep the air pressure of the inside of the negative chamber 21 to a certain negative level.

A press roller 25 for pressing the produced nonwoven fabric is arranged downstream to the negative pressure and chamber 21 and outside of the porous roll and the produced nonwoven fabric is separated from the porous roll after passing under the press roller 25.

In this example using a nonwoven fabric manufacturing set having a configuration as described above, the diameter of the air passage holes 12a of the porous roll was uniformly 1.5 mm and the density of holes was 18/cm$^2$, while the thickness of the porous plate 12 that constituted the porous roll was 0.5 mm.

The resin material used for this example was polypropylene having a melt flow rate of 300 and the polypropylene was extruded from the capillary tubes having an opening caliber of 0.4 mm and arranged at a pitch of 0.7 mm at an extrusion rate of 0.6 gr/opening/min. and resin temperature of 280° C. Air at 260° C. having a pressure of 0.6 kg/cm$^2$ was used as heated gas for blowing molten resin and elongating resin filaments. The collection distance was 8 cm and the degree of vacuum in the negative pressure chamber 21 behind the porous plate 12 was −500 mmHg.

Figure 8:
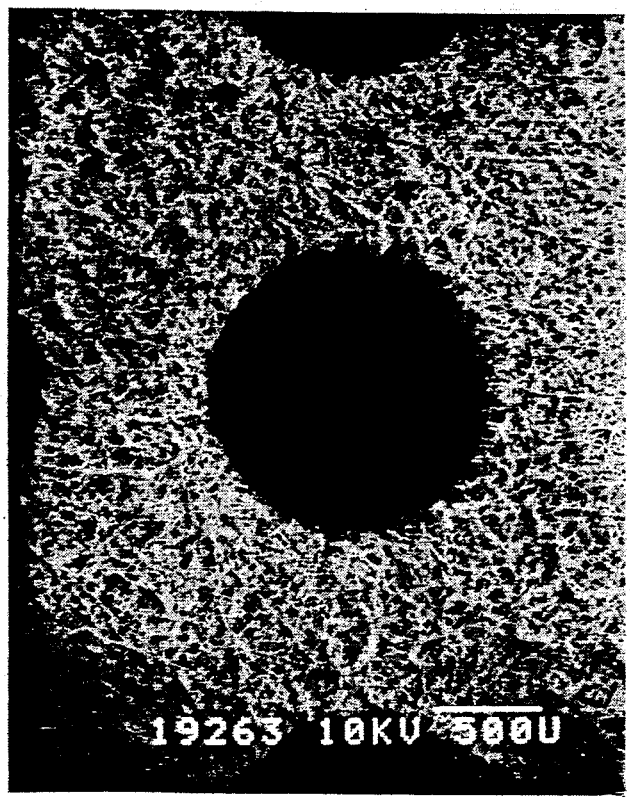
Figure 9:
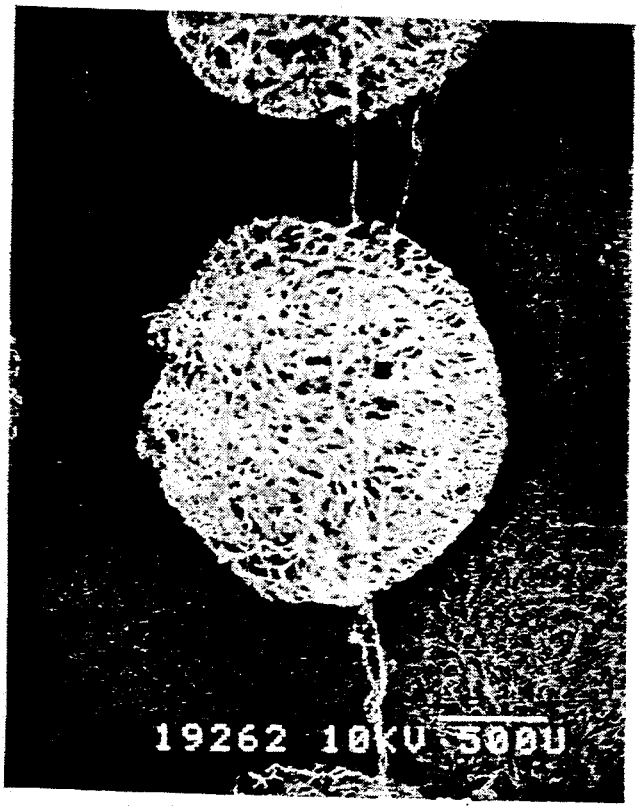
Figure 10:
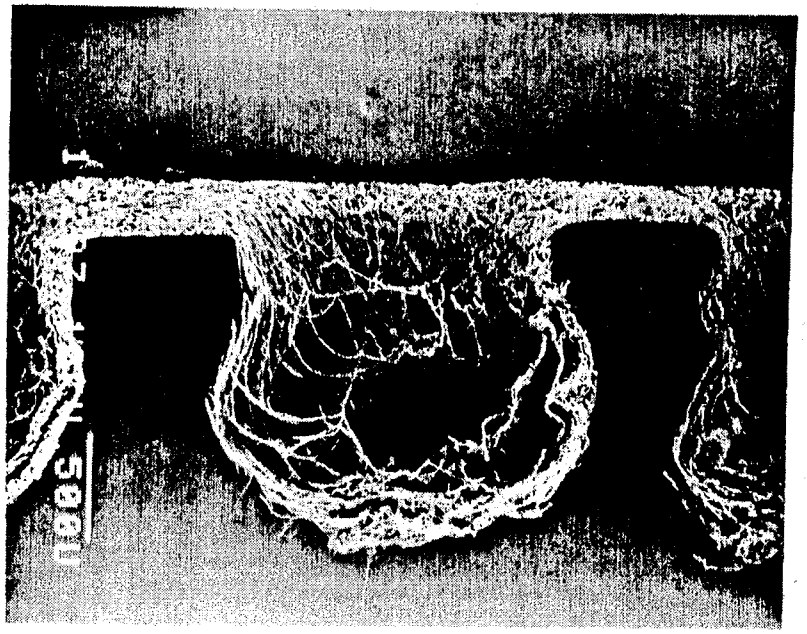

The obtained melt-blow type nonwoven fabric had a weight per unit area of 60 gr/cm$^2$, an average filament diameter of 6 um, a hole diameter of 1.3 mm, a hole density of 18/cm$^2$, an apparent height of the projections 2 of approximately 1.4 mm and an apparent thickness of the base cloth layer of approximately 0.2 mm. FIGS. 8 through 10 show photographs of various areas of the obtained nonwoven fabric of this example taken through a scanning type electronic microscope of 30 magnifications. As is apparent from the photographs, the projections 2 were made of filaments sames as those of the base cloth layer 1.

The obtained melt-blow type nonwoven fabric was very bulky as it had an apparent specific gravity of 0.04. The nonwoven fabric had an excellent covering effect and a high gas permeability and was very soft, giving itself a very comfortable feeling.

EXAMPLE 2

A melt-blow type nonwoven fabric was obtained under conditions which are the same as those of Example 1 above except that the degree of vacuum of the negative pressure chamber 21 behind the porous plate 12 was −1,000 mmHg.

Figure 11:
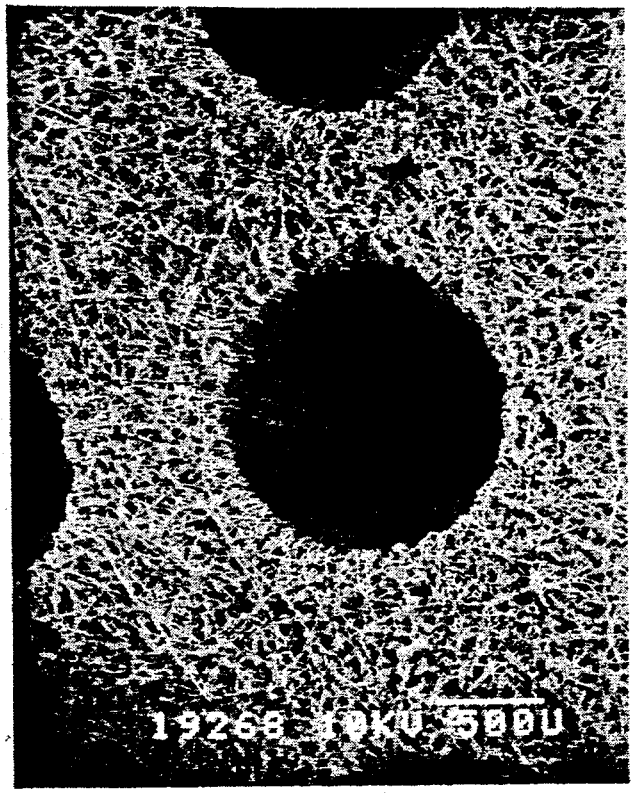
Figure 12:
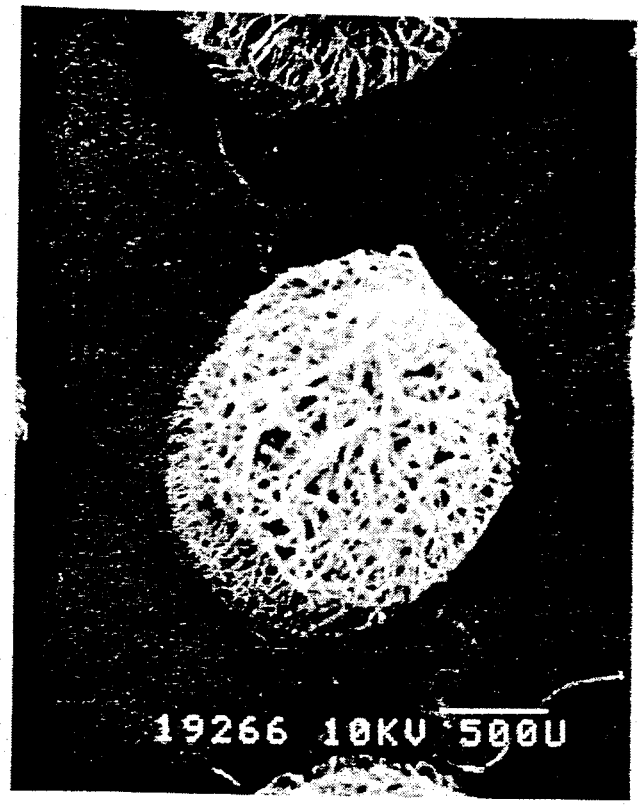
Figure 13:
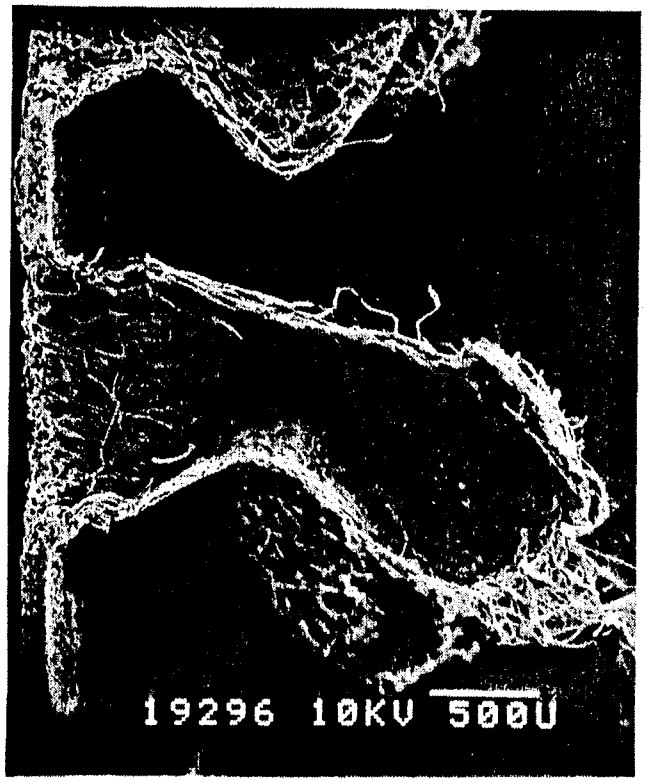

The obtained melt-blow type nonwoven fabric had a weight per unit of 60 gr/cm$^2$, an average filament diameter of 6 um, a hole diameter of 1.3 mm, a hole density of 18/cm$^2$, an apparent height of the projections 2 of approximately 2.4 mm and an apparent thickness of the base cloth layer of approximately 0.2 mm. FIGS. 11 through 13 show photographs of various areas of the obtained nonwoven fabric of this example taken through a scanning type electronic microscope of 30 magnifications.

The obtained nonwoven fabric had an excellent covering effect and a high gas permeability and was very soft, giving itself a very comfortable feeling.

EXAMPLE 3

In this example, a flat metal net was used as a porous plate 12. The metal net was rounded to a roll to form a collector apparatus 13. The metal net was of #30 mesh with a wire diameter of 0.3 mm, each of the meshes having a size of 0.54 mm×0.60 mm.

The resin material used for this example was polypropylene having a melt flow rate of 300 and the polypropylene was extruded from the capillary tubes having an opening caliber of 0.4 mm and arranged at a pitch of 0.7 mm at an extrusion rate of 0.6 gr/opening/min. and resin temperature of 280° C. Air at 260° C. having a pressure of 0.6 kg/cm$^2$ was used as heated gas for blowing molten resin and elongating resin filaments. The collection distance was 8 cm and the degree of vacuum in the negative pressure chamber 21 behind the porous plate 12 was −500 mmHg.

Figure 14:
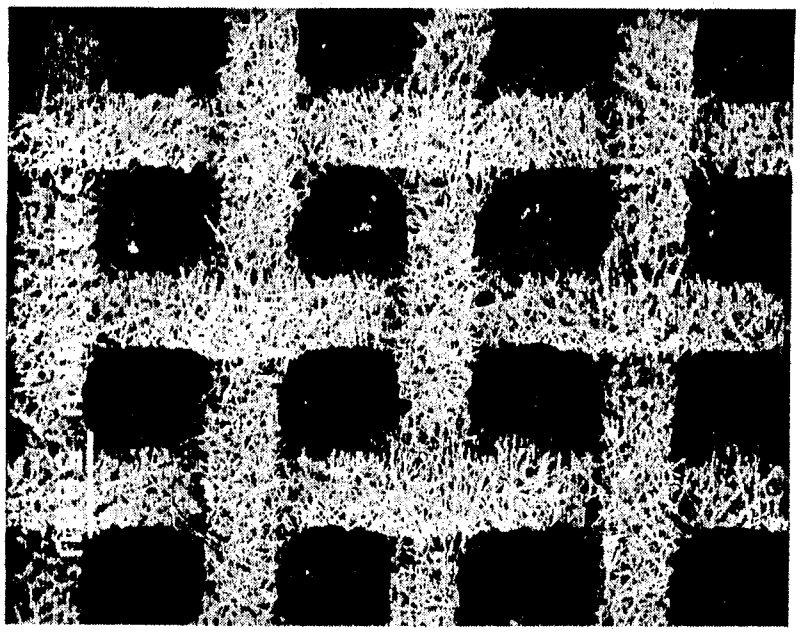
Figure 15:
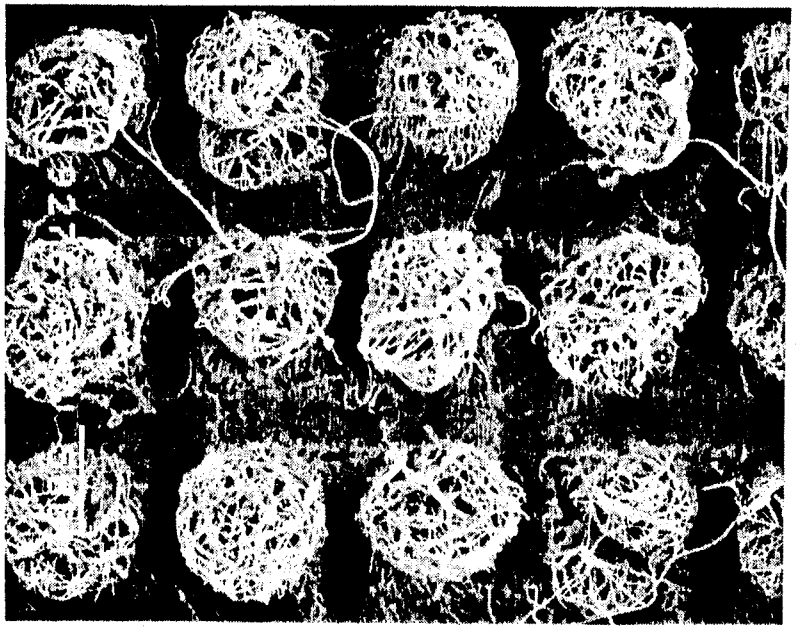
Figure 16:
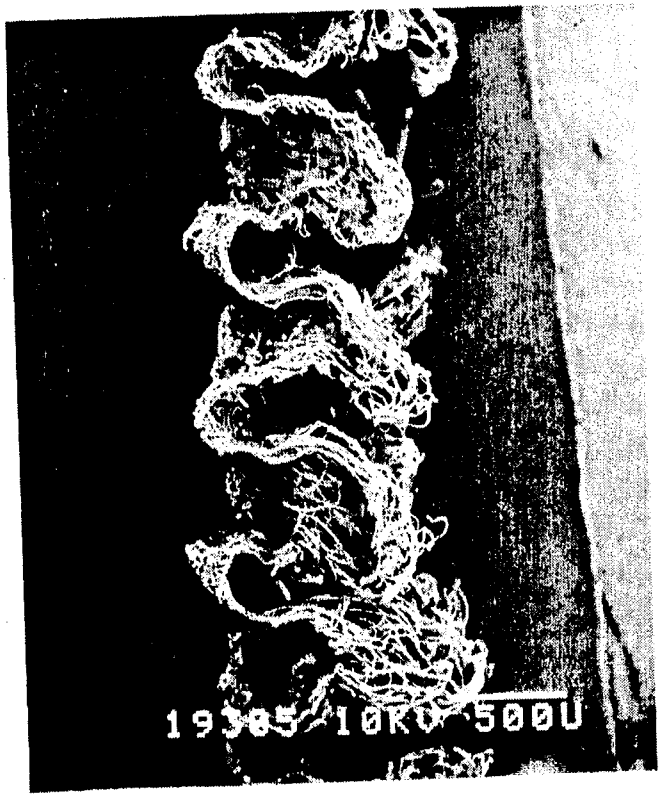

The obtained melt-blow type nonwoven fabric had a weight per unit area of 40 gr/cm$^2$, an average filament diameter of 6 um, a hole diameter of 0.6 mm, a hole density of 125/cm$^2$, an apparent height of the projections of approximately 0.8 mm and an apparent thickness of the base cloth layer of approximately 0.1 mm. FIGS. 14 through 16 show photographs of various areas of the obtained nonwoven fabric of this example taken through a scanning type electronic microscope of 30 magnifications. As is apparent from the photographs, the projections 2 were made of filaments same as those of the base cloth layer 1.

The obtained melt-blow type bulky nonwoven fabric was very nappy and had an apparent specific gravity of 0.04. It had an excellent covering effect and a high gas permeability and was very soft, giving itself a very comfortable feeling.

EMBODIMENT 2

Now a second embodiment of the invention will be described by referring to FIGS. 17 through 24.

This embodiment of the invention as illustrated in FIGS. 17 through 24 is formed by thermoplastic resin filaments and comprises a base cloth layer 1 provided with a number of holes 1*a* and the same number of cylindrical projections 2 each formed around the corresponding hole 1*a*, the cylindrical projections 2 being made of filaments similar to those of the base cloth layer 1 and therefore soft, the free ends 2*a* of the projections 2 being open, the projections 2 having a height (h) at least twice as large as the thickness (t) of the base cloth layer 1. The embodiment is a melt-blow type nonwoven fabric and is manufactured by a method according to the invention.

In short, this embodiment differs from Embodiment 1 in that the free ends of the projections are open. Since the rest is similar to its counterpart of Example 1, it will be not be explained any further.

The diameter of the holes 1*a* is between 0.2 and 6 mm, preferably between 0.4 and 2 mm. A hole with a diameter less than 0.2 mm is not recommendable because the cylindrical projection standing from the periphery of the hole 1*a* can be easily separated. To the contrary, holes with a diameter greater than 6 mm can give a coarse touch and disagree with the surface of an object to which they are applied and which can be jaggy.

The embodiment of the melt-blow type nonwoven fabric of the invention is manufactured by a method as described below.

Melt-blow filaments are blown out from a melt-blow die onto a porous plate having a large number of air passage holes until a deposit of filaments is formed on the plate. During this blowing operation, the pressure of the ambient air on the side of the plate opposite to the melt-blow die is made lower than the air pressure on the side of the plate facing the die so that some of the filaments blown onto the plate come to project from the air passage holes to form so many cylindrical projections as they are pulled by the negative pressure.

So, the method of manufacturing the second embodiment is characterized in that, after forming the projections which take the form of so many cylinders and the free ends of the cylindrical projections getting burst open by air pressure, the aggregate of the filaments deposited on the plate is removed from the latter.

An apparatus as illustrated in FIGS. 4 through 7 for the melt-blow operation of Embodiment 1 can be used for Embodiment 2 under similar operating conditions without modifications. Therefore, further explanation of the apparatus will be omitted.

As filaments are deposited on the porous plate 12, a base cloth layer 1 is formed on the surface of the plate 12 except the area of the air passage holes 12*a*, where the base cloth layer 1 shows corresponding holes 1*a*, each carrying a projection 2 made of the same resin material and standing from the peripheral edge of it toward the opposite side of the plate 12 due to the difference of pressure. The gas pressure applied to the filaments blown toward the plate should be high enough relative to the air pressure of the opposite side in order to elongate the projections 2 formed on the base cloth layer 1 and realize sufficiently elongated cylindrical projections 2 each having a free end burst open by the gas pressure. When such projections 2 are formed, the deposited aggregate of filaments on the porous plate 12 is removed from the plate 12 to obtain a melt-blow type nonwoven fabric.

Therefore, the apparatus is operated under same conditions as those of the Embodiment 1 except that the free ends of the cylindrical projections 2 are burst open.

The final product of such a melt-blow type nonwoven fabric may find a number of applications including the top-layer sheet of a diaper, the top-layer sheet of a sanitary napkin, a shock-absorbent and a water-repellent sheet. When a sheet of film or paper or another nonwoven fabric is bonded to the projections-carrying side of such a nonwoven fabric, the final product will be a sheet similar to a corrugated cardboard that can be suitably used for thermal and/or sound insulation.

EXAMPLE 4

A nonwoven fabric was prepared in a manner similar to that of Example 1 under the following conditions.

The diameter of the air passage holes 12 of the porous roll was uniformly 1.5 mm and the density of air passage holes 12*a* was 18/cm$^2$, while the thickness of the porous plate 12 that constituted the porous roll was 0.5 mm.

The resin material used for this example was polypropylene having a melt flow rate of 300 and the polypropylene was extruded from the capillary tubes having an opening caliber of 0.4 mm and arranged at a pitch of 0.7 mm at an extrusion rate of 0.6 gr/opening/min. and resin temperature of 280° C. Air at 280° C. having a pressure of 0.7 kg/cm$^2$ was used as heated gas for blowing molten resin and elongating resin filaments. The collection distance was 5 cm and the degree of vacuum in the negative pressure chamber 21 behind the porous plate 12 was −1.000 mmHg. The atmospheric temperature for the collecting operation was approximately 80° C.

After having the free ends 2*a* of the projections 2 burst open under air pressure, the obtained melt-blow type nonwoven fabric had a weight per unit area of 40 gr/cm$^2$, an average filament diameter of 6 um, a hole diameter of 1.3 mm, a hole density of 18/cm$^2$, an apparent height of the projections of approximately 1.5 mm and an apparent thickness of the base cloth layer of approximately 0.13 mm. FIGS. 20 through 22 show photographs of various areas of the obtained nonwoven fabric of this example taken through a scanning type electronic microscope of 30 magnifications. As is apparent from the photographs, the projections 2 were made of filaments sames as those of the base cloth layer 1.

The obtained porous melt-blow type nonwoven fabric was subjected to a hydrophilic treatment by using a surface active agent and placed on a water absorbing layer of a diaper. When 100 cc of water was poured on the melt-blow type nonwoven fabric, the water was instantaneously absorbed by the water absorbing layer to evidence an excellent water permeability of the nonwoven fabric.

The nonwoven fabric had a high gas permeability and was very soft, giving itself a very comfortable feeling.

EXAMPLE 5

An nonwoven fabric was prepared under conditions same as those of Example 1 except that a metal net having a wire diameter of 0.3 mm and a mesh size of 0.54 mm×0.60 mm was used as a porous plate 12.

The obtained melt-blow type nonwoven fabric had a weight per unit area of 40 gr/cm$^2$, an average filament diameter of 6 um, a hole diameter of 0.6 mm, a hole density of 130/cm$^2$, an apparent height of the projections of approximately 0.9 mm and an apparent thickness of the base cloth layer of approximately 0.13 mm. FIGS. 23 and 24 respectively show photographs of a part of the front side and that of the rear side of the obtained nonwoven fabric of this example taken through a scanning type electronic microscope of 30 magnifications.

The obtained porous melt-blow type nonwoven fabric was subjected to a hydrophilic treatment by using a surface active agent and laid on a water absorbing layer of a diaper. When 100 cc of water was poured on the melt-blow type nonwoven fabric, the water was instantaneously absorbed by the water absorbing layer to evidence an excellent water permeability of the nonwoven fabric.

The nonwoven fabric had a high gas permeability and was very soft, giving itself a very comfortable feeling.

EMBODIMENT 3

Now a third embodiment of the invention will be described by referring to FIGS. 25 through 27 as well as examples illustrated in FIGS. 30 and 31.

This embodiment is realized by laying resin film on the projection-carrying side of a nonwoven fabric produced by the method as described for Embodiment 1 or 2.

More specifically, a resin film layer 1*b* is laid on a base cloth layer 1 having a large number of holes 1*a* and made of a thermoplastic resin material and a cylindrical projection 2*c* having a closed or open free end is formed on each of the holes 1*a* and then the outer peripheral surface of each of the cylindrical projections 2*c* is covered by a film layer 1*b*. The projections 2*c* have a height (h) at least twice as large as the thickness (t) of the base cloth layer 1.

In short, this embodiment is made of resin film and a melt-blow type nonwoven fabric.

Any of the thermoplastic resin materials listed for the Embodiment 1 may be used for the film and the nonwoven fabric of this embodiment.

Film to be used for the purpose of this embodiment has a thickness between 5 um and 200 um and preferably between 10 um and 30 um. It may be uniaxially extended, biaxially extended or nonextended.

The type and the length of filaments that form the base cloth layer 1 and the cylindrical projections 2 may be appropriately modified as in the case of Embodiment 1.

The height of the cylindrical film projection 2*b* that surrounds the outer peripheral surface of the cylindrical projection 2*c* may not be same as that of the latter. While FIG. 30 shows a cylindrical projection 2*c* having an exposed top section above the top end of the surrounding cylindrical film projection 2*b*, the top section of the cylindrical projection 2*c* may alternatively be covered by the top section of the cylindrical film projection 2*b*. When the cylindrical projections 2*c* stand higher than the cylindrical film projections 2*b* , they give a very soft feeling as it is fiber-like filaments that touch the user's skin. As shown in FIG. 31, the cylindrical projection 3*c* may have a closed free end.

It should be noted that upper portions of the projections 2*c* and 2*b* are not necessarily straight cylindrical but may be tapered toward the free ends or conversely tapered toward the lower ends in the form of so many funnels. As an alternative, the cylindrical projections 2*c* may not be covered by cylindrical film projections 2*b*.

The combination of projections 2*c* and 2*b* improves the resilient and shock-absorbing properties of the final product.

All the other parameters of this embodiment are similar to those of Embodiments 1 and 2.

The embodiment 3 is prepared by the following method.

Resin film 1*b* is laid on a porous plate 12 provided with a large number of air passage holes 12*a* and heated to a temperature higher than the softening point of the film while the air pressure on the side of the porous plate 12 that does not receive filaments is reduced relative to the air pressure on the other side so that the resin film 1b is drawn by the negative pressure through the air passage holes 12a into the negative pressure area to form so many cylindrical film projections 2b each having an open free end 2a. Then, filaments of the thermoplastic resin material are blown from a melt-blow die 10 against the resin film 1b having the holes to form a base cloth layer 1c on the resin film 1b. At this stage, some of the filaments are drawn into the cylindrical film projections 2b because of the pressure difference between the two sides of the porous plate 12 and a cylindrical projection 2c of the nonwoven fabric is formed within each of the cylindrical film projections 2b. The formed combination of resin film and nonwoven fabric is finally separated from the porous plate 12.

The resin film 1b is prepared by using the T-die technique, the circular die technique or any known technique.

Alternatively, the resin film 1b may simply be so processed as to carry many holes and then filaments of the thermoplastic resin material are blown on the resin film 1b by means of the melt-blow technique until cylindrical projections 2 are formed on the other side of the porous plate 12 through the holes of the resin film 1b.

The apparatus for manufacturing the embodiment is realized by modifying the apparatus used for Embodiments 1 and 2 as illustrated in FIGS. 28 and 29. It comprises an additional heating device 26 for heating the resin film applied on the porous plate 12. Since all the other components of the apparatus are same as those of its counterpart of Examples 1 and 2, they are indicated by the same reference numerals and further explanation is omitted.

Firstly, the resin film 1b that has been prepared in advance is placed on the front side of the porous plate 12 and the air pressure on the other side is reduced to draw the resin film 1b through the air passage holes of the plate 12 into the other side by the negative pressure. Meanwhile, the resin film 1b is heated by the heating device 26 until it reaches a temperature higher than the softening point of the resin material of the film.

The softened resin film 1b is deformed by negative pressure at those areas that are found on the air passage holes 12a of the porous plate 12 to form projections standing around the edges of the holes toward the other side of the porous plate 12 to form cylindrical film projections 2b each having an open free end.

Then, molten resin is extruded from the melt-blow die 10 and at the same time pressurized and heated gas is blown off from the gas blowing orifices 11 to drive filaments of the molten thermoplastic resin onto the film 1b having small holes. Filaments are continuously blown onto the film 1b, which is being rotated, before they are cooled below the softening point so that a continuous layer of filaments or the base cloth layer 1c is deposited on the film 1b. Since a gas flow can only mildly elongate filaments, they should be kept above the softening point of the resin material so that they are evenly elongated and eventually broken to form so many cylindrical projections 2c with open or closed free ends.

When filaments are blown from the melt-blow die apparatus onto the porous plate 12, the rear side of the porous plate 12 is kept under negative pressure to draw part of the filaments deposited on the film 1b through the holes of the film 1b toward the rear side of the plate 12. Consequently, a cylindrical projection 2c of filaments is formed within each of the cylindrical film projections 2b.

Since the resin film 1b is directly placed on the porous plate 12, it carries the base cloth layer 1 on it to form a two-layer structure.

In the final stage of manufacture, the nonwoven fabric having a resin film lining is separated from the porous plate 12.

The base cloth layer 1c of such a nonwoven fabric may be treated either hydrophilically by a surface active agent or hydrophobically by a water-repellent agent.

When such a porous two-layer nonwoven fabric sheet is used for the top sheet of a paper diaper or a sanitary napkin, it is advisable to place the projection-carrying side of the sheet on a water-absorbing sheet to better its water absorbing capability.

A nonwoven fabric produced in a manner similar to that of this embodiment is suitably used for a shock-absorbing sheet or a water-repellent sheet. When a sheet of film or paper or another nonwoven fabric is bonded to it on the projection-carrying side, a product like a corrugated cardboard is obtained and advantageously used for heat and/or sound insulation.

EXAMPLE 6

An apparatus as illustrated in FIGS. 28 and 29 was used. The diameter of each of the air passage holes 12a of the porous roll was 1.5 mm and the air passage holes 12a were distributed at a rate of 18/cm$^2$. The thickness of the porous plate 12 that constitutes the porous roll was 0.5 mm.

Firstly, a sheet of low density polyethylene film 1b was continuously placed on the porous roll. The film had a thickness of 20 um.

The film 1b placed on the porous roll was heated at a location near the negative chamber 21 by hot air of 200° C. coming from the heating device 26 and then drawn into the negative chamber 21 at the air passage holes 12a until the drawn areas become broken to form so many holes. The resin around each of the holes is extended into the other side of the porous plate 12 to form a cylindrical film projection 2b having an open free end. The degree of vacuum in the negative pressure chamber 21 was −1.000 mmHg.

The resin material used for this example was polypropylene having a melt flow rate of 300 and the polypropylene was extruded from the capillary tubes having an opening caliber of 0.4 mm and arranged at a pitch of 0.7 mm at an extrusion rate of 0.6 gr/opening/min. and resin temperature of 280° C. Air at 280° C. having a pressure of 0.7 kg/cm$^2$ was used as heated gas for blowing molten resin and elongating resin filaments. The collection distance was 5 cm. The atmospheric temperature for the collecting operation was approximately 80° C.

Some of the filaments deposited on the film 1b were pulled through the holes of the film 1b into the negative chamber to form cylindrical projections 2c having an open free end, each being surrounded by the corresponding cylindrical film projection 2b.

Then the formed nonwoven fabric was separated from the porous roll. The obtained nonwoven fabric had a weight per unit area of 20 gr/cm$^2$, an average filament diameter of 6 um, a hole diameter of 1.3 mm, a hole density of 18/cm$^2$. The cylindrical nonwoven fabric projections 2c had an apparent height of approximately 1.5 mm and the cylindrical film projections 2b had an apparent height of approximately 0.9 mm. The apparent thickness of the portion of the product where the base cloth layer 1c and the film 1b were layered was approximately 0.1 mm.

The base cloth layer 1c of the obtained nonwoven fabric was subjected to a hydrophilic treatment by using a surface active agent and placed on a water absorbing layer of a diaper. When 100 cc of water was poured on the nonwoven fabric, the water was instantaneously absorbed by the water absorbing layer to evidence an excellent water permeability of the nonwoven fabric.

EXAMPLE 7

An nonwoven fabric was prepared under conditions same as those of Example 6 except that a metal net having a wire diameter of 0.3 mm and a mesh size of 0.98 mm×0.98 mm was used as a porous plate 12.

The obtained nonwoven fabric had a weight per unit area of 40 gr/cm$^2$, an average filament diameter of 6 um, a hole diameter of 0.9 mm, a hole density of 62/cm$^2$, an apparent height of the projections of approximately 1.1 mm and an apparent height of the combination of the base cloth layer 1c and the film layer 1b of approximately 0.13 mm.

The obtained nonwoven fabric was subjected to a hydrophilic treatment by using a surface active agent and laid on a water absorbing layer of a diaper. When 100 cc of water was poured on the nonwoven fabric, the water was instantaneously absorbed by the water absorbing layer to evidence an excellent water permeability of the nonwoven fabric.

The nonwoven fabric had a high gas permeability and was very soft, giving itself a very comfortable feeling.

EFFECTS OF THE INVENTION

As is apparent from the above description, according to the present invention, there is provided a bulky nonwoven fabric made of thermoplastic resin filaments, which is soft and highly permeable to water and gas and effectively absorbs moisture as well as shocks. Such a nonwoven fabric finds many applications including those as described above.

What is claimed is:

1. A method of manufacturing a nonwoven fabric by blowing melt-blow type filaments from a melt-blow die toward a porous plate having a large number of air passage holes to deposit the filaments on the plate while reducing the air pressure on the side other than the filament carrying side relative to that of the filament carrying side to draw some of the filaments through the air passage holes into the other side and form cylindrical projections, the aggregate of filaments being separated from the porous plate as a nonwoven fabric in the final stage of operation.

2. A method of manufacturing a nonwoven fabric comprising the steps of:

placing a sheet of resin film on a porous plate provided with a large number of air passage holes and heating the resin film above the softening point of the resin.

reducing at the same time the ambient air pressure on the side opposite to the melt-blow die lower than the air pressure of the other side so that the resin film may projects from the air passage holes to the side opposite to the die to form so many cylindrical film projections having an open free end and subsequently blowing molten filaments from a melt-blow die onto the resin film with the cylindrical film projections so that they may deposit on the resin film and part of the filaments may be pulled into the cylindrical film projections to form cylindrical projection of the filaments within the cylindrical film projections, the combined film and filaments being then taken away from the porous plate.

3. A method of manufacturing a nonwoven fabric according to claim 1, wherein the obtained nonwoven fabric is separated from the porous plate after some of the filaments are sufficiently drawn to form cylindrical projections each having a closed free end.

4. A method of manufacturing a nonwoven fabric according to claim 1, wherein the obtained nonwoven fabric is separated from the porous plate after some of the filaments are sufficiently drawn to form cylindrical projections each having an open free end.

5. A method of manufacturing a nonwoven fabric according to claim 1 or 2, wherein air pressure on the side other than the filament carrying side of the porous plate is reduced relative to that of the filament carrying side to draw some of the filaments through the air passage holes into the negative pressure side by means of the pressure difference between the two sides of the porous plate.

6. A method of manufacturing a nonwoven fabric according to claim 1 or 2, wherein the porous plate is moved close to the melt-blow die to generate a pressure different between the two sides of the porous plate and drive some of the filaments into the air passage holes of the porous plate to form projections on the other side of the plate by the air blow pressure applied from the melt-blow die.

7. A method of manufacturing a nonwoven fabric according to claim 1 or 2, wherein the porous plate is a 5 to 60 mesh metal net.

* * * * *